US011805808B1

(12) United States Patent
Contreras

(10) Patent No.: US 11,805,808 B1
(45) Date of Patent: Nov. 7, 2023

(54) FIRE BONG

(71) Applicant: Olga Dircia Contreras, Hallandale, FL (US)

(72) Inventor: Olga Dircia Contreras, Hallandale, FL (US)

( * ) Notice: Subject to any disclaimer, the term of this patent is extended or adjusted under 35 U.S.C. 154(b) by 189 days.

(21) Appl. No.: 17/300,450

(22) Filed: Jul. 6, 2021

Related U.S. Application Data

(63) Continuation-in-part of application No. 16/602,327, filed on Sep. 16, 2019, now Pat. No. 11,058,146, which is a continuation-in-part of application No. 16/501,747, filed on Jun. 4, 2019, now Pat. No. 10,750,776, which is a continuation-in-part of application No. 15/362,825, filed on Nov. 29, 2016, now Pat. No. 10,357,058.

(51) Int. Cl.

| | |
|---|---|
| ***A24F 1/28*** | (2006.01) |
| ***A24F 1/30*** | (2006.01) |
| ***F23Q 7/16*** | (2006.01) |
| ***A24F 5/00*** | (2006.01) |

(52) U.S. Cl.
CPC ..... *A24F 1/30* (2013.01); *A24F 5/00* (2013.01); *F23Q 7/16* (2013.01)

(58) Field of Classification Search
CPC ..... A24F 1/28
See application file for complete search history.

(56) References Cited

U.S. PATENT DOCUMENTS

| | | | | |
|---|---|---|---|---|
| 2013/0051422 | A1* | 2/2013 | Landry | A24F 1/30 372/50.23 |
| 2015/0257443 | A1* | 9/2015 | Rado | A24F 42/10 392/390 |
| 2017/0020196 | A1* | 1/2017 | Cameron | A24F 40/50 |

FOREIGN PATENT DOCUMENTS

| | | | | |
|---|---|---|---|---|
| DE | 202004005609 U1 * | 8/2004 | | A24F 1/30 |
| WO | WO-2014028337 A1 * | 2/2014 | | A24F 47/008 |

* cited by examiner

*Primary Examiner* — Cynthia Szewczyk

(57) ABSTRACT

A rechargeable battery-operated ignition smoking bong including a replaceable nichrome wire within an indentation on an inner perimeter of a bowl of the bong body, a fuel reservoir directly below and adjacent the interior cavity of the bowl, an ignition switch on a stem of a bong body to selectively activate one of the nichrome wire and an amount of fuel within the fuel reservoir to combust an ignitable smoking substance, such as tobacco, contained within the bowl, and a filter disposed between the stem and the bowl. The present device permits one-handed ignition to combust the smoking substance. The rechargeable battery-operated ignition smoking bong also includes a micro USB outlet and wireless charging receptacles to permit the bong to recharge without the hassle of changing batteries.

4 Claims, 16 Drawing Sheets

FIG. 1A1
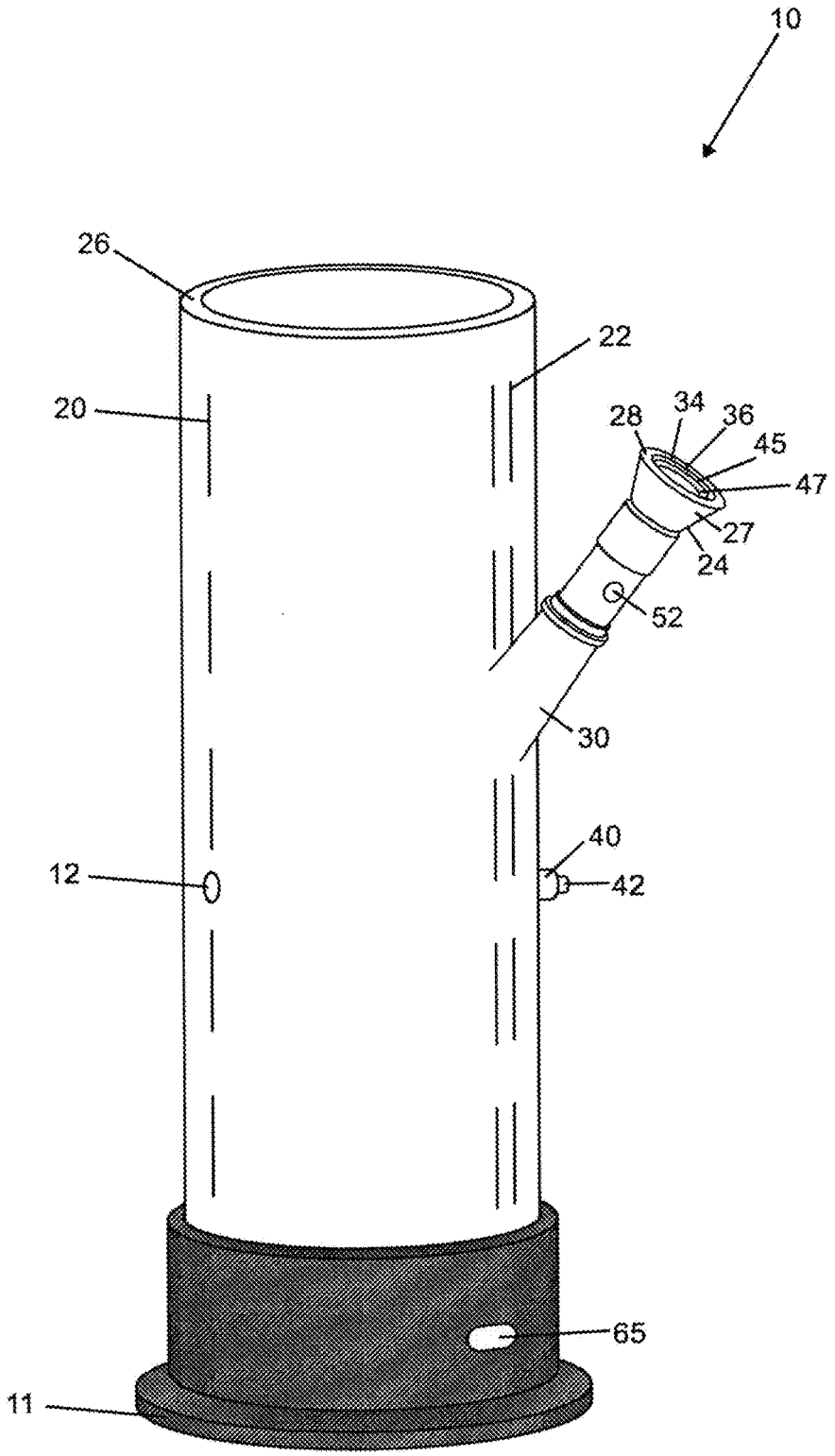

FIG. 2A1
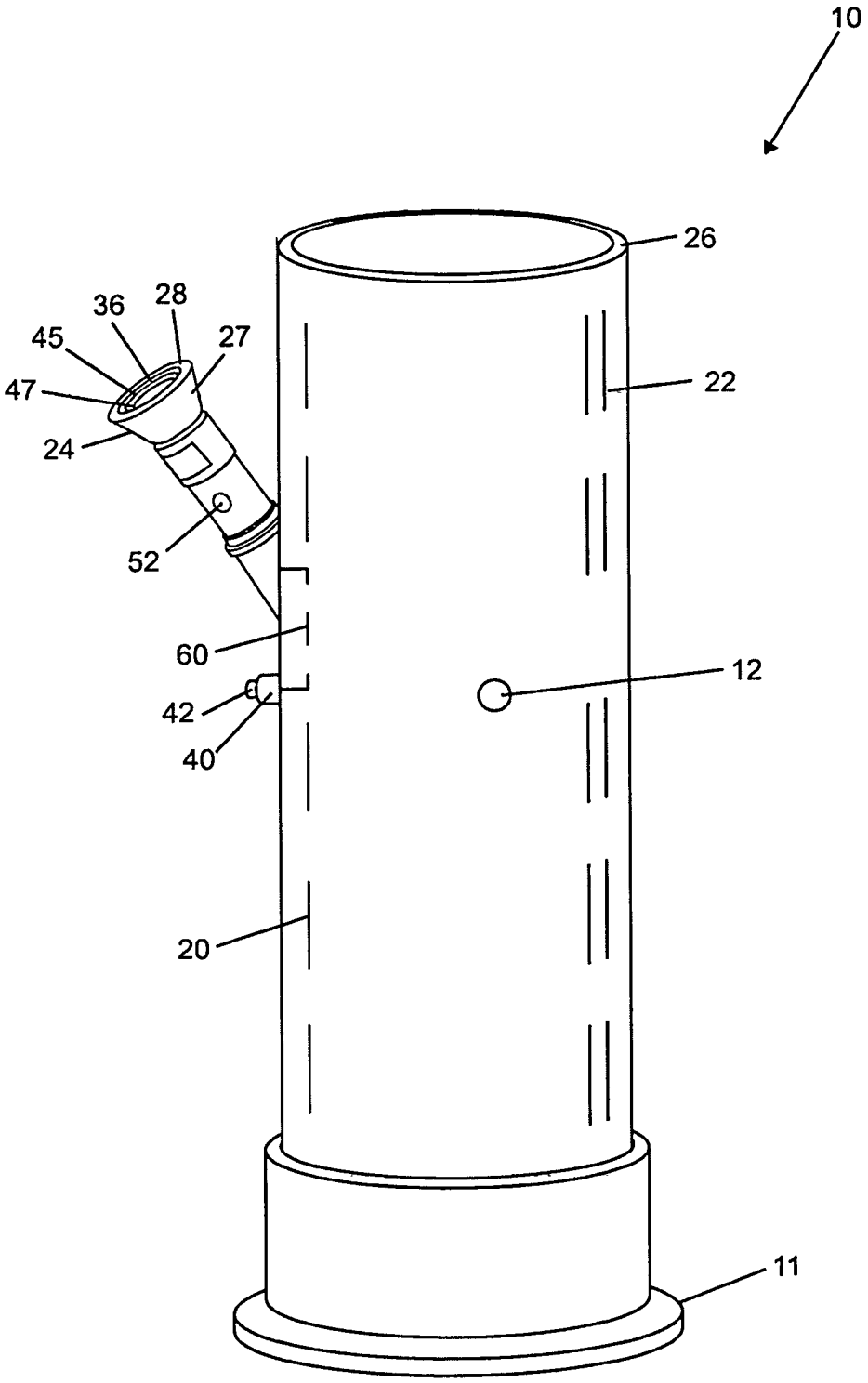

FIG. 3A1
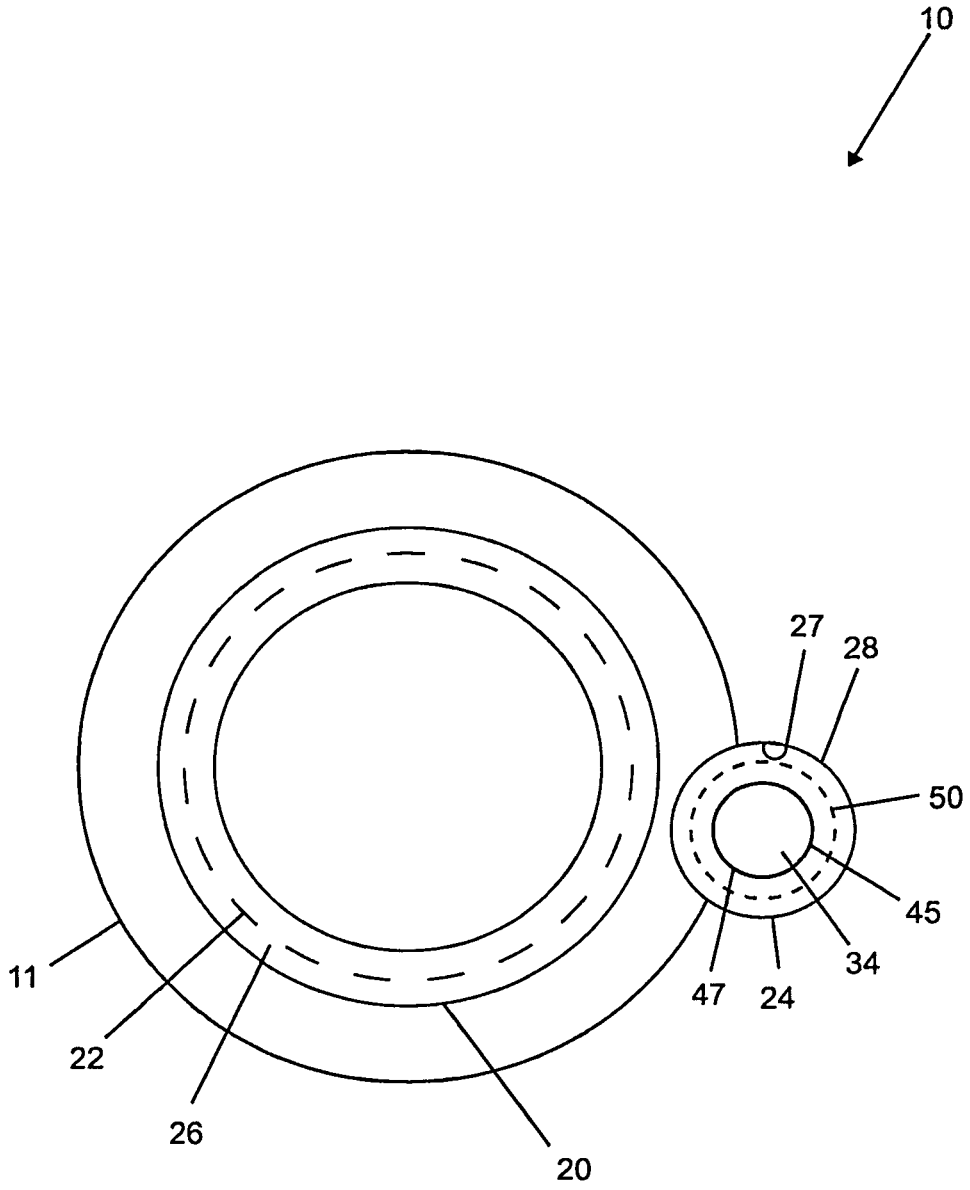

FIG. 4A1
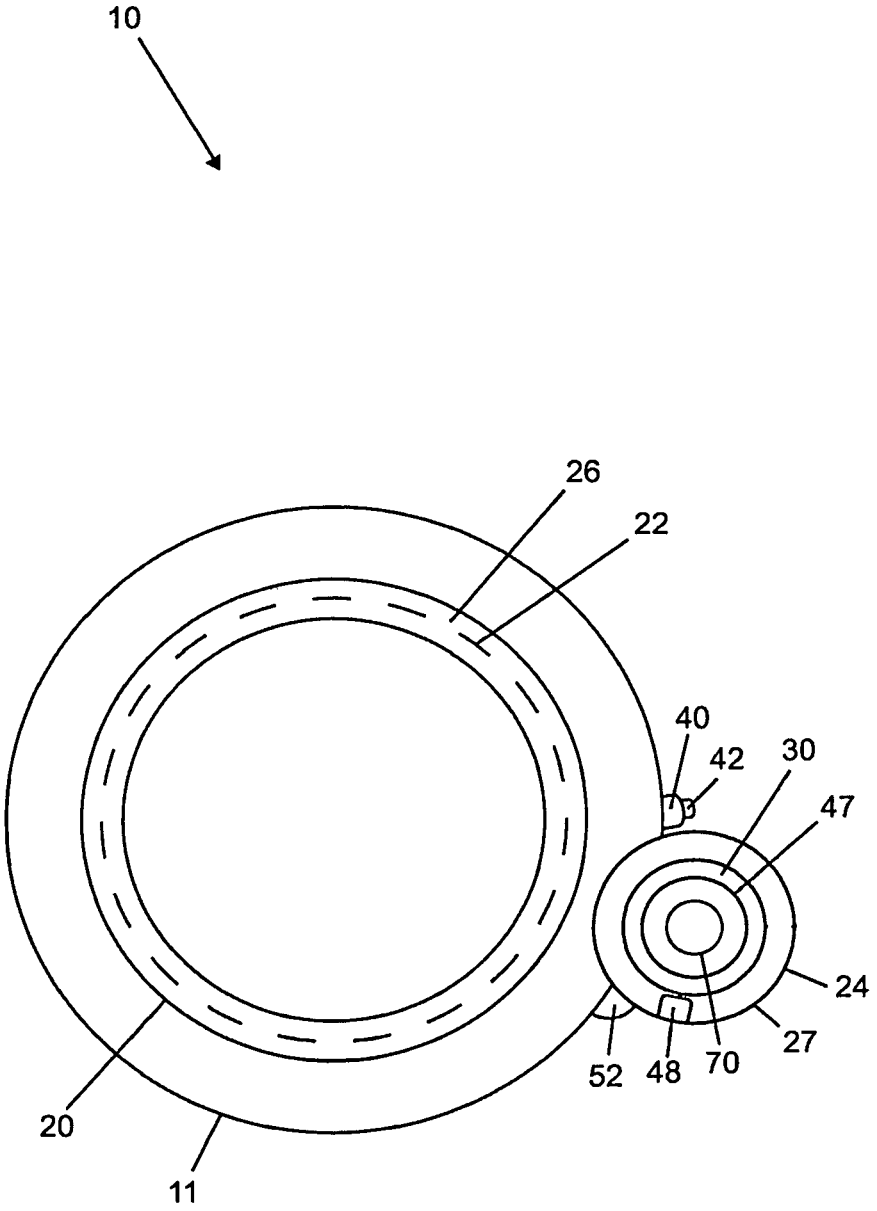

FIG. 5A1
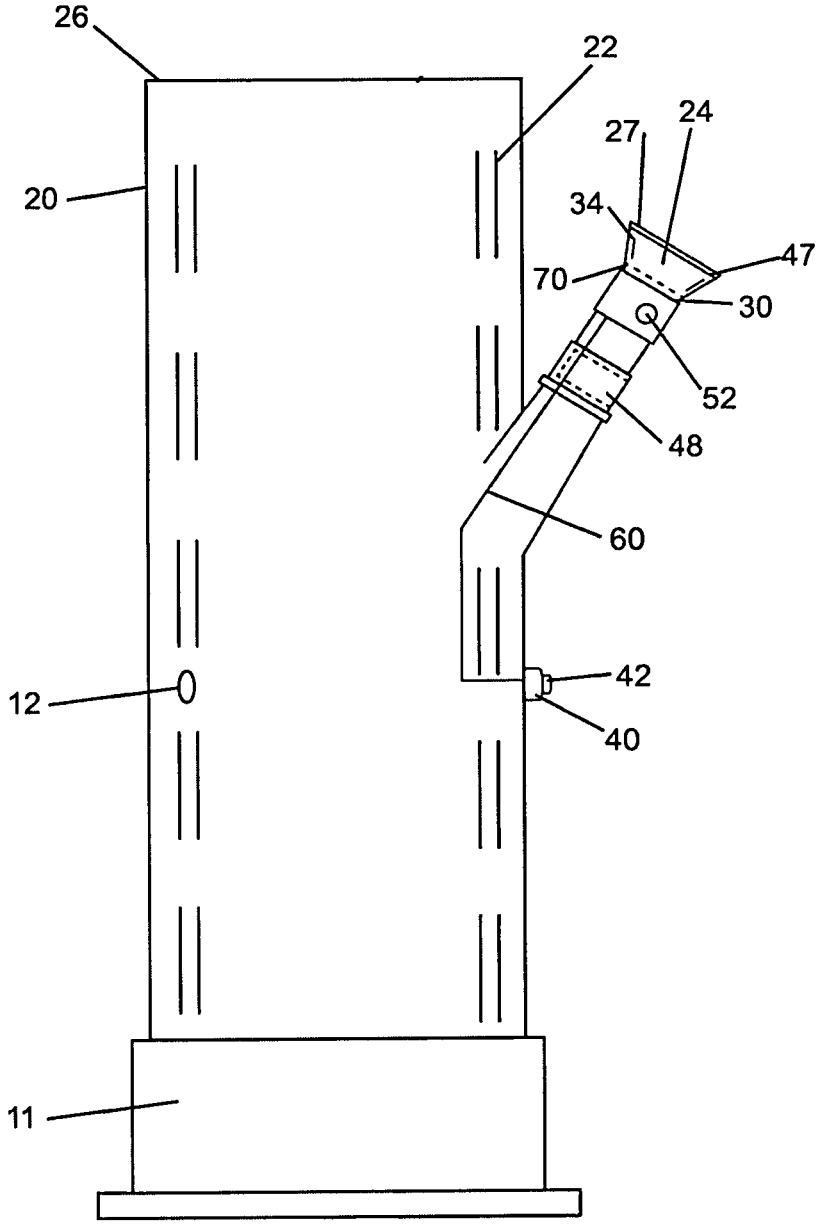

FIG. 5A2
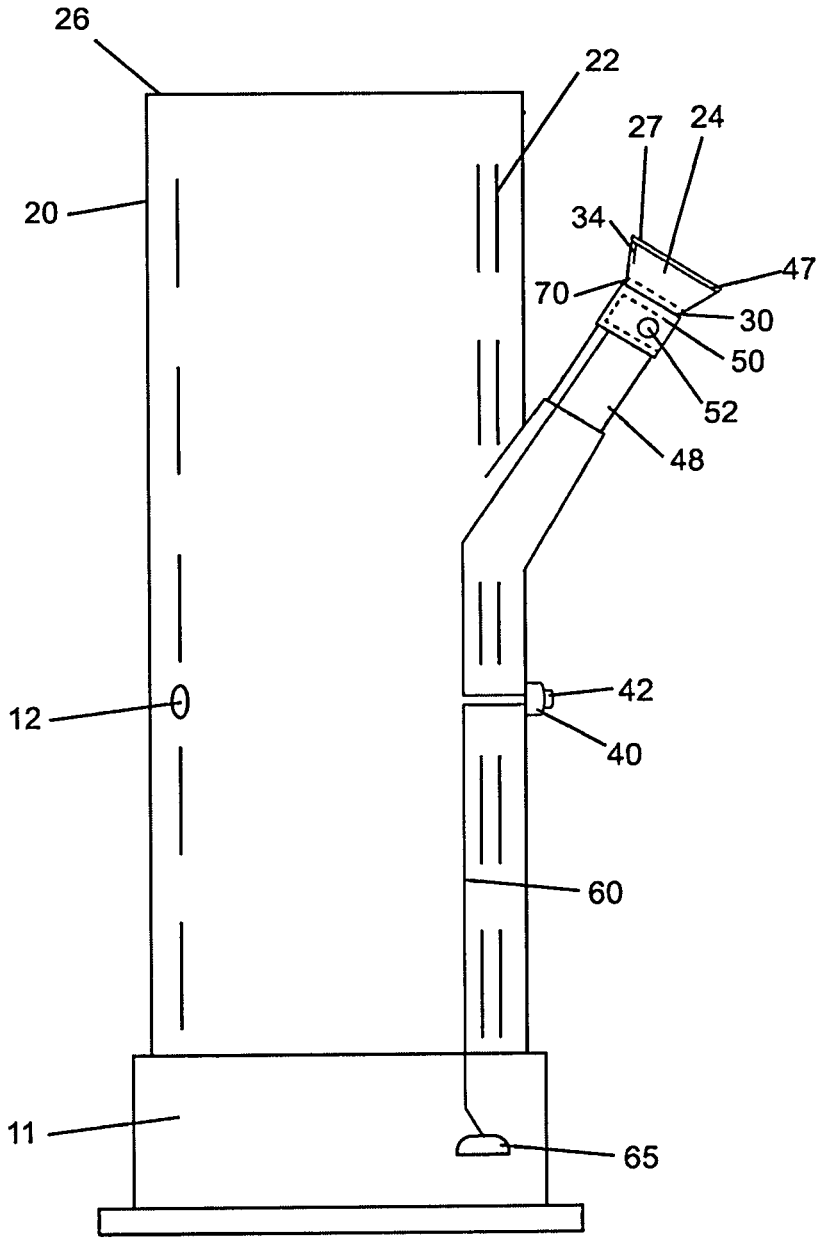

FIG. 5B1
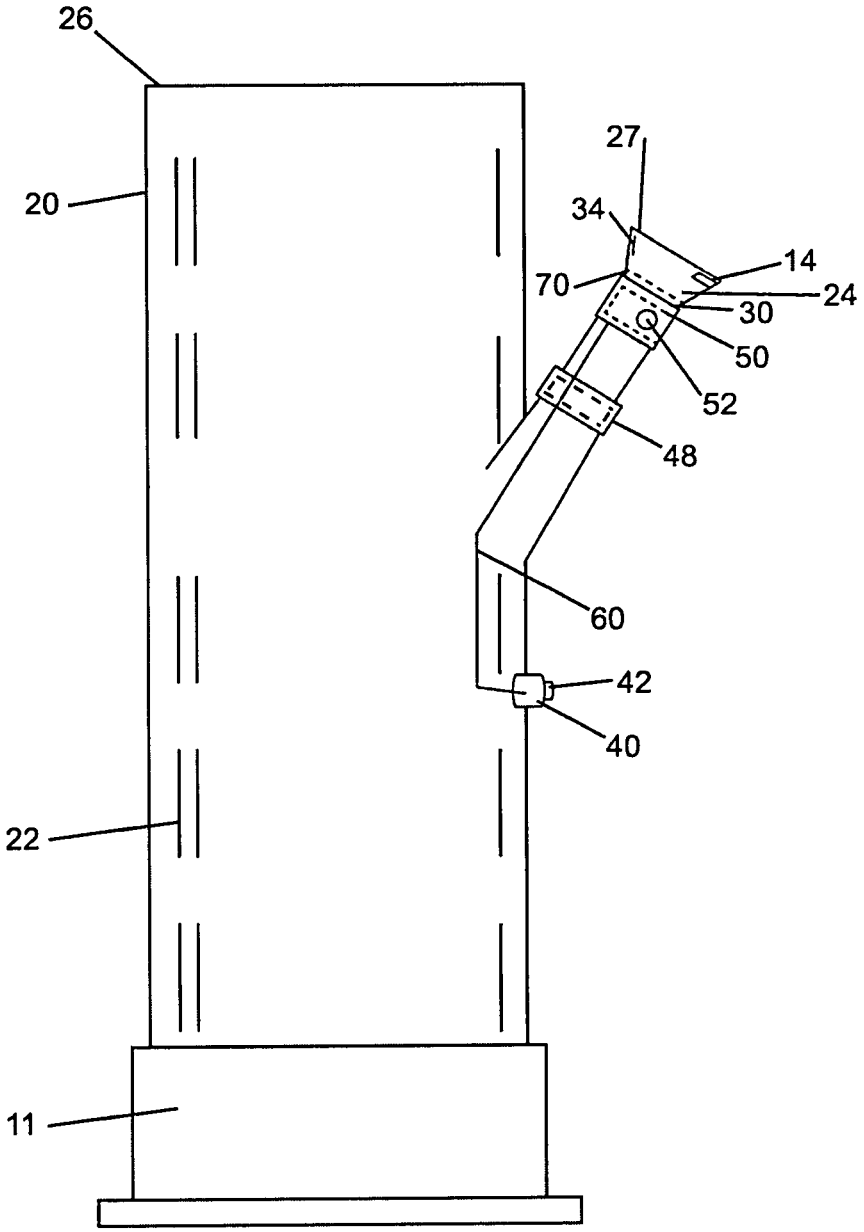

FIG. 5B2
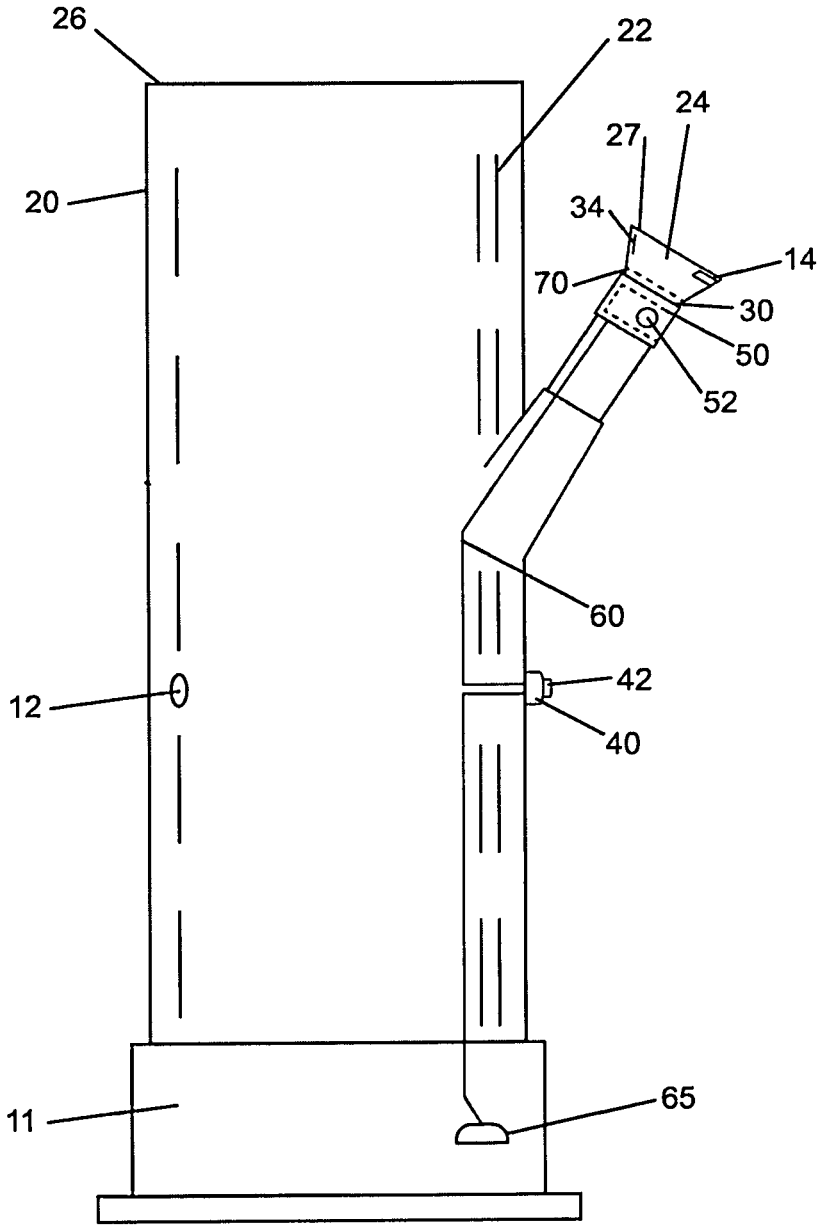

FIRE BONG

CROSS REFERENCE TO RELATED APPLICATIONS

This application is a CIP of U.S. patent application Ser. No. 16/602,327, filed Sep. 16, 2019 which is a CIP of U.S. patent application Ser. No. 16/501,747, filed Jun. 4, 2019 which is a CIP of U.S. patent application Ser. No. 15/362,825, filed Nov. 29, 2016, each of which applications are hereby incorporated by reference in their entirety.

Be it known that Olga Contreras, a citizen of Costa Rica, have invented new and useful improvements in a battery-operated ignition smoking pipe as described in this specification.

BACKGROUND OF THE INVENTION

Various types of smoking bongs are known in the prior art. However, what is needed and what is provided here in is a battery-operated ignition smoking bong which provides a replaceable nichrome wire disposed on an inner perimeter of a bowl of the bong body, a full reservoir disposed directly below and directly adjacent to the bowl, an ignition switch disposed on a stem of a bong body which selectively activates one of the nichrome wire and amount of fuel within the fuel reservoir to combust an ignitable smoking substance, such as tobacco, disposed within the bowl, and a filter disposed between the stem and the bowl. The present device permits one-handed ignition to combust the smoking substance more easily and faster than is possible with manual ignition of a bong without the nichrome wire, the fuel reservoir and the ignition switch. In addition, the filter reduces the amount of smoke, any tar present, and fine particles which would otherwise be inhaled during combustion of the smoking substance. The filter further reduces the harshness of the smoke produced when compared to a smoking bong without the filter.

FIELD OF THE INVENTION

The present invention relates to smoking bong, and more particularly, to a battery-operated ignition smoking bong.

SUMMARY OF THE INVENTION

The general purpose of the present rechargeable battery-operated ignition smoking bong, described subsequently, in greater detail, is to provide a rechargeable battery-operated ignition smoking bong which has many novel features that result in a rechargeable battery-operated ignition smoking bong, which is not anticipated, rendered obvious, suggested, or even implied by prior art. Either alone or in combination thereof. To accomplish this, the present rechargeable battery-operated ignition smoking bong includes a single construction bong body having a stem, a bowl, a mouthpiece extending through the stem and in fluid communication with the bowl, and an outer wall of the stem and the bowl. The bowl has a top edge, a bottom end, an interior cavity defined by the top edge, the bottom end, and the outer wall of the bowl, as well as the inner perimeter of the interior cavity. A battery-operated ignition switch is disposed within. The stem has an activation button disposed on the stem. A length of replaceable nichrome wire is removeably disposed within a continuous indentation disposed along the inner perimeter proximal the top edge. A battery, disposed within the stem, or in the proximal bottom, either way is in operational communication with the ignition switch. A fuel reservoir, disposed directly below and directly adjacent to the bowl, is configured to contain an amount of fuel, such as a lighter fluid, therein. A refill nozzle on the outer wall of the bowl adjacent the fuel reservoir, is in fluid communication with the fuel reservoir. An igniter wire is continuously disposed from the ignition switch, to the battery, and encircles the interior cavity. The igniter wire is in operational communication with the length of nichrome wire. The ignition switch is configured to activate the igniter wire and upon activation of the igniter wire, the igniter wire is configured to selectively activate the length of nichrome wire to ignite an ignitable smoking substance, such as tobacco, disposed within the interior cavity of the bowl and alternately directly ignite the amount of fuel within the fuel reservoir to combust the ignitable smoking substance disposed within the interior cavity of the bowl. The smoker, thus, has the option of igniting the smoking substance by placing the nichrome wire within the indention or by placing the amount of fuel within the fuel reservoir through the refill nozzle, followed by pressing the activation button of the ignition switch. A filter, provided to reduce the amount of smoke, any tar present, and fine particles which would otherwise be inhaled during combustion of the smoking substance and to reduce the harshness of the smoke, is transversely disposed directly between the stem and the bowl. Thus, has been broadly outlined the more important features of the present-operated ignition smoking bong so that the detailed description thereof that follows may be better understood and in order that the present contribution to the art may be better appreciated.

The bowl comprises of a built in battery that is rechargeable through three types of chargers. One that is predesigned to accommodate the smoking bong by holding it securely as it charges. Second, it is compatible with any micro USB power cable, thirdly compatible with its own predesigned wireless charger, as well as any wireless charger. the bong can be designed with a battery in the stem or in the bowl.

BRIEF DESCRIPTION OF THE DRAWINGS

Figures

FIG. 1A1 is a front isometric view of a second embodiment.

FIG. 2A1 is rear isometric view of the second embodiment.

FIG. 3A1 is a top plan view of the third embodiment.

FIG. 4A1 is a bottom plan view of the second embodiment.

FIG. 5A1 is a cross-sectional view.

FIG. 5A2 is a cross-sectional view.

FIG. 5B1 is a cross-sectional view.

FIG. 5B2 is a cross-sectional view.

DETAILED DESCRIPTION OF THE INVENTION

Figure 1A:
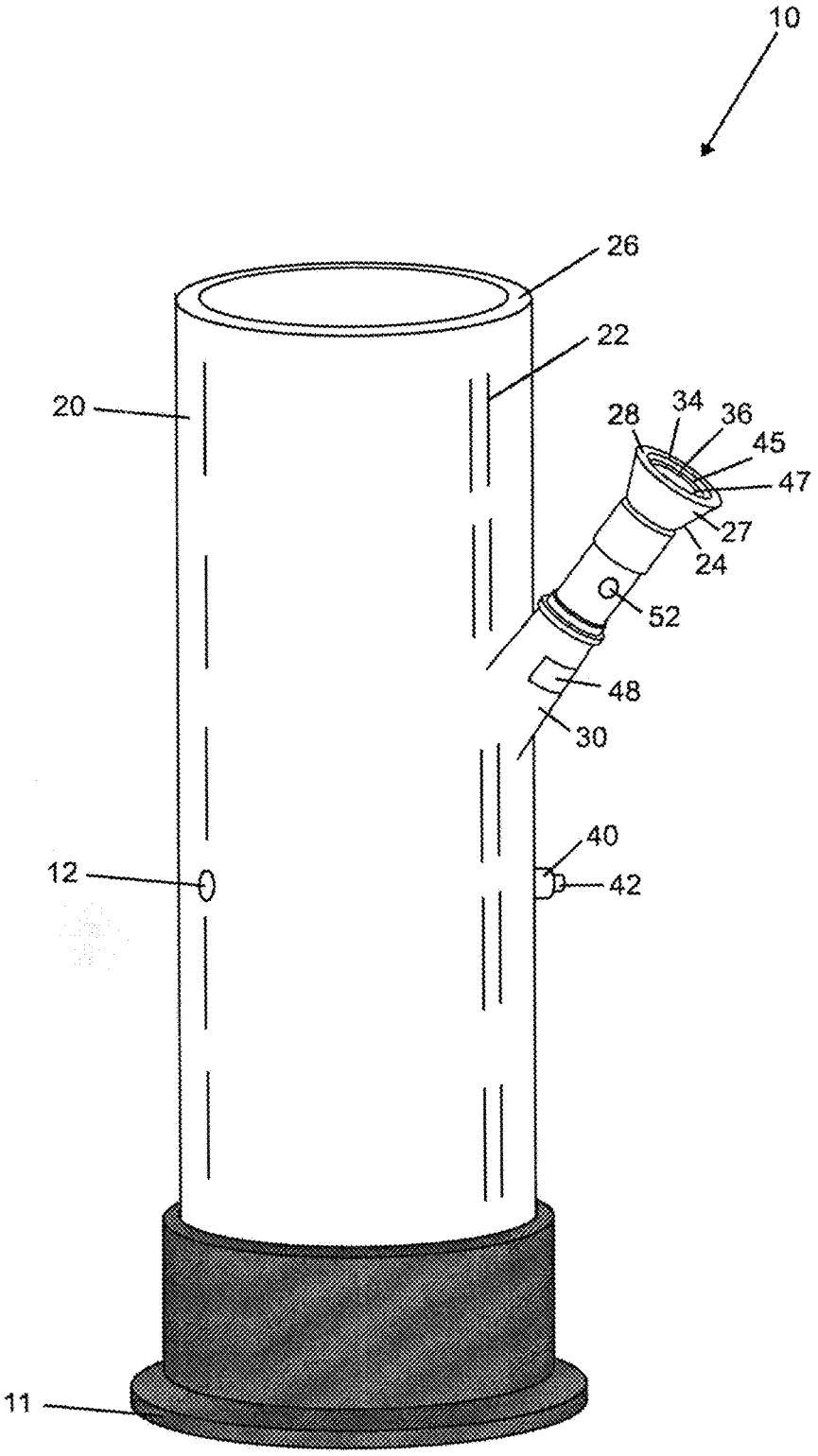
FIG. 1A is a front isometric view.

With reference now to the drawings, and in particular FIGS. 1A, 2A, 3A, 4A, and 5A1, an example of the instant rechargeable battery-operated ignition smoking bong employing the principles and concepts of the present battery-operated ignition smoking bong and generally designated by the reference number 10 will be described. Referring to FIGS. 1A, 2A, 3A, 4A, and 5A1 the present rechargeable battery-operated ignition smoking bong 10 is illustrated. The rechargeable battery-operated ignition smoking bong 10 includes a single construction bong body 20 extending vertically from a bottom base 11. The bong body 20 also includes a carb hole 12. As shown in FIG. 1, the bottom base 11 has a wider diameter than the bong body 20. The bong body 20 having a stem 22, a bowl 24, a mouthpiece 26 extending through the stem 22 and in fluid communication with the bowl 24, and an outer wall 27 of the stem 22 and the bowl 24. The bowl 24, has a top edge 28, a bottom end 30, an interior cavity 34 defined by the top edge 28, the bottom end 30, and the outer wall 27 of the bowl 24. The bowl 24 further includes an inner perimeter 36 of the interior cavity 34. The outer wall 27 of the bowl has a micro USB charge receptacle 65 built into it.

A fuel reservoir 50 is disposed directly below and directly adjacent to the interior cavity 34 of the bowl 24 proximal the bottom end 30. The fuel reservoir 50 is configured to contain an amount of fuel, such as lighter fluid, therein. A refill nozzle 52 is accessibly disposed on the outer wall 27 of the bowl 24 adjacent the fuel reservoir 50. The refill nozzle 52 is in fluid communication with the fuel reservoir 50.

An igniter wire, 60 is continuously disposed from the ignition switch 40, to the battery 48, and encircles the interior cavity 34. A first portion of the igniter wire 60 is disposed in a position between the fuel reservoir 50 and the interior cavity 34. A second portion of the igniter wire 60 is disposed between the stem 22 and the interior cavity 34. The igniter wire 60 is in operational communication with the length of nichrome wire 47. The ignition switch, 40 is configured to activate the igniter wire 60. Upon activation of the igniter wire 60, the igniter wire 60 is configured to selectively activate the length of nichrome wire 47 to ignite and ignitable smoking substance, such as tobacco disposed within the interior cavity 34 of the bowl 24 and alternately directly ignite the amount of fuel within the fuel reservoir 50 to combust the ignitable smoking substance disposed within the interior cavity 34 of the bowl 24. A filter 70 is transversely disposed directly between the stem 22 and the bowl 24. The second portion 64 of the igniter wire 60 Is further disposed between the filter 70 and the interior cavity 34.

The smoker, thus, has the option of igniting the smoking substance within the interior cavity 34 by placing the nichrome wire 47 within the indentation 45 or by placing the amount of fuel within the fuel reservoir 50 through the refill nozzle 52 followed by pressing the activation button 42 of the ignition switch 40.

While the bong has been disclosed with both the fuel source and nichrome wire above, the invention can be embodied with these features individually as well. Below is disclosed in a second embodiment with only the fuel source for igniting the smoking substance and in a third embodiment only using the nichrome wire for igniting the smoking substance.

Second Embodiment

With reference to FIGS. 1A1, 2A1, 3A1, 3B and 4A1, the second embodiment of the rechargeable battery operated ignition smoking bong is disclosed. In the second embodiment, the inventive smoking bong does not include a fuel source, but instead, only includes the nichrome wire for igniting a smoking substance.

In the second embodiment, the rechargeable battery operated ignition smoking bong 10 includes a single construction bong body 20. The bong body 20 having a stem 22, a bowl 24, a mouthpiece 26 extending through the stem 22 and in fluid communication with the bowl 24, and an outer wall 27 of the stem 22 and the bowl 24. The bowl 24 has a top edge 28, a bottom end 30, an interior cavity 34 defined by the top edge 28, the bottom end 30, and the outer wall 27 of the bowl 24. The bowl 24 further includes an inner perimeter 36 of the interior cavity 34. Either way, a battery 48, can be disposed in the stem 22, or can be disposed in the bottom end 30, A micro USB charge receptacle 65 is built into the outer wall 27. The bowl has a removable lid at the proximal bottom 30.

A battery operated ignition switch 40 is disposed within the stem 22. The ignition switch 40 has an activation button 42 disposed on the stem 22. A continuous indentation 45 is disposed along the inner perimeter 34 proximal the top edge 28. A length of replaceable nichrome wire 47 is removably disposed within the indentation 45. A battery 48 is disposed within the proximal bottom end 30, and also can be disposed in the stem 22, either way is in operational communication with the ignition switch 40.

An igniter wire 60 is continuously disposed from the ignition switch 40, to the battery 48, and encircles the interior cavity 34. A first portion 62 of the igniter wire 60 is disposed at a bottom of the bowl 24 in the interior cavity 34. A second portion 64 of the igniter wire 60 is disposed between the stem 22 and the interior cavity 34. The igniter wire 60 is in operational communication with the length of nichrome wire 47. The ignition switch 60 is configured to activate the igniter wire 60. Upon activation of the igniter wire 60, the igniter wire 60 is configured to activate the length of the nichrome wire 47 to ignite an ignitable smoking substance, such as tobacco, disposed within the interior cavity 34 of the bowl 24 to combust the ignitable smoking substance disposed within the interior cavity 34 of the bowl 24.

A filter 70 is transversely disposed directly between the stem 22 and the bowl 24. The second portion 64 of the igniter wire 60 is further disposed between the filter 70 and the interior cavity 34.

Third Embodiment

With reference to FIGS. 1B, 2B, 4B, 5A1, 5A2, 5B1, and 5B2 a third embodiment of the rechargeable battery-operated ignition smoking bong is disclosed. In the third embodiment, the inventive smoking bong does not include the nichrome wire for igniting the smoking substance, but instead, only includes the fuel for igniting the smoking substance.

In the third embodiment, the battery-operated ignition smoking bong includes a single construction pipe body having a stem 22, a bowl 24, a mouthpiece 26 extending through the stem 22 in fluid communication with the bowl 24, and an outer wall 27 of the stem 22 and the bowl 24. The bowl 24 has a top edge 28, a bottom end 30, a flame nozzle 14, an interior cavity 34 defined by top edge 28, the bottom end 30, and the outer wall 27 of the bowl 34, as well as an inner perimeter 34 of the interior cavity 34. A micro USB charge receptacle 65, is built into the outer wall 27.

A battery-operated ignition switch 40 is disposed within stem 22. The ignition switch 40 has an activation button 42 disposed on the stem 22. A battery 48, disposed within the bottom end 30, is in operational communication with the ignition switch 40.

An igniter wire 60 is continuously disposed from the ignition switch 40, to the battery 48, and ends at the interior cavity 34, near the fuel reservoir 50. The ignition switch 60, is configured to activate the igniter wire 60. Upon activation of the igniter wire 60. The igniter wire 60 is configured to directly ignite the amount of fuel within the fuel reservoir 50 to combust the ignitable smoking substance disposed within the interior cavity 34 of the bowl 24 with fire emitted through the flame nozzle 14.

A filter 70 is transversely disposed directly between the stem 22 and the bowl 24.

Figure 1B:
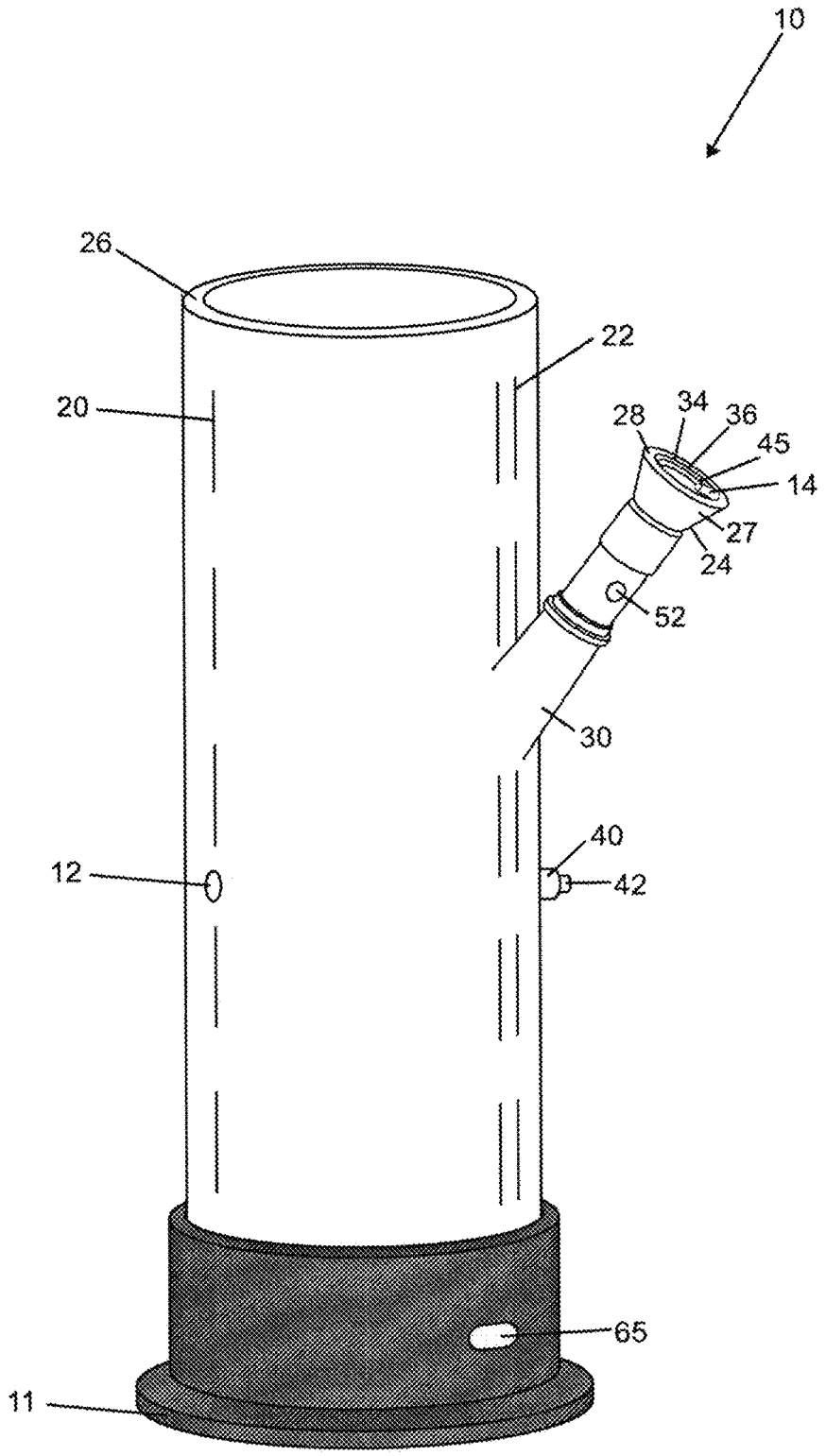
FIG. 1B is a front plan view of the third embodiment.
Figure 2A:
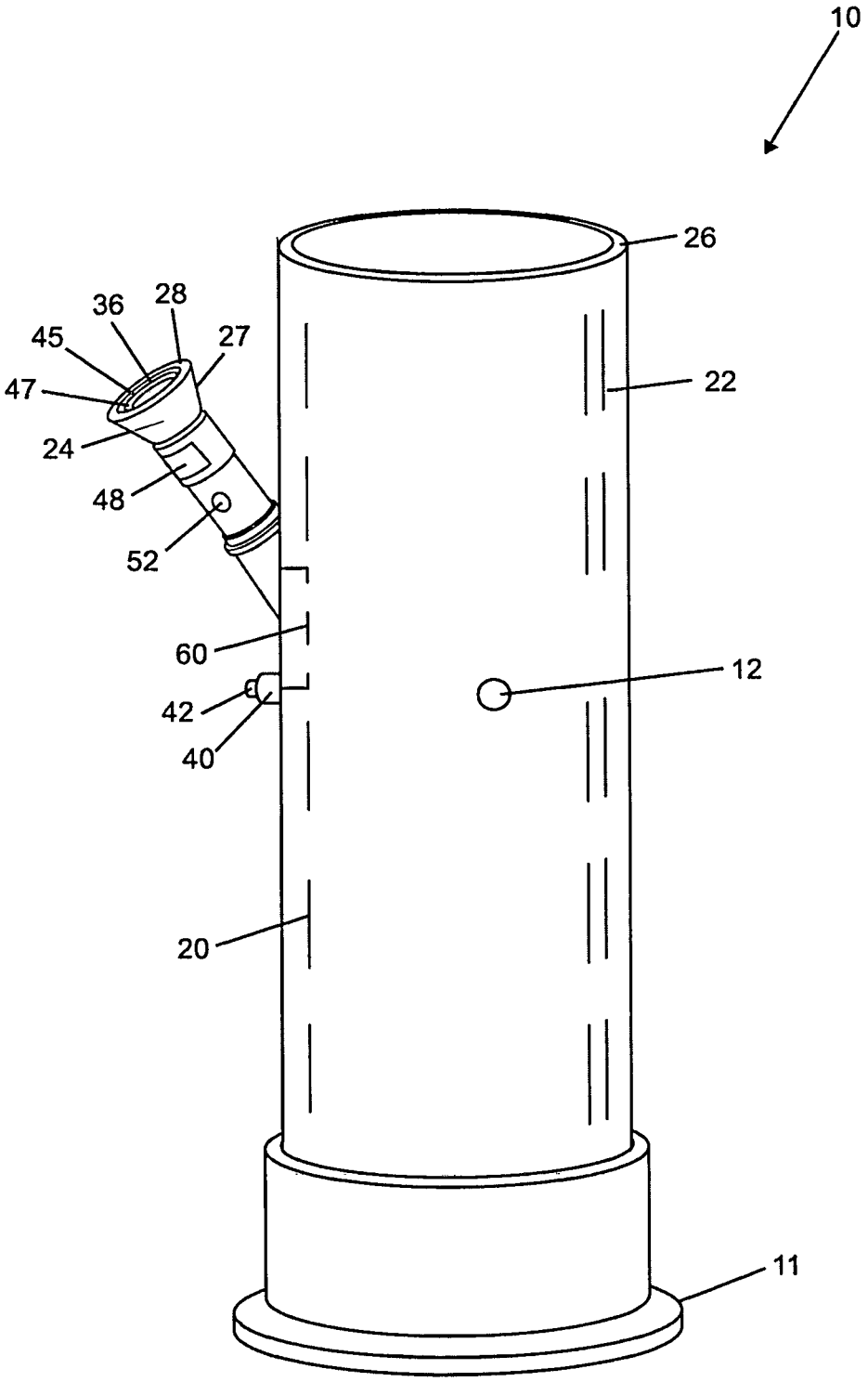
FIG. 2A is a rear isometric view.
Figure 2B:
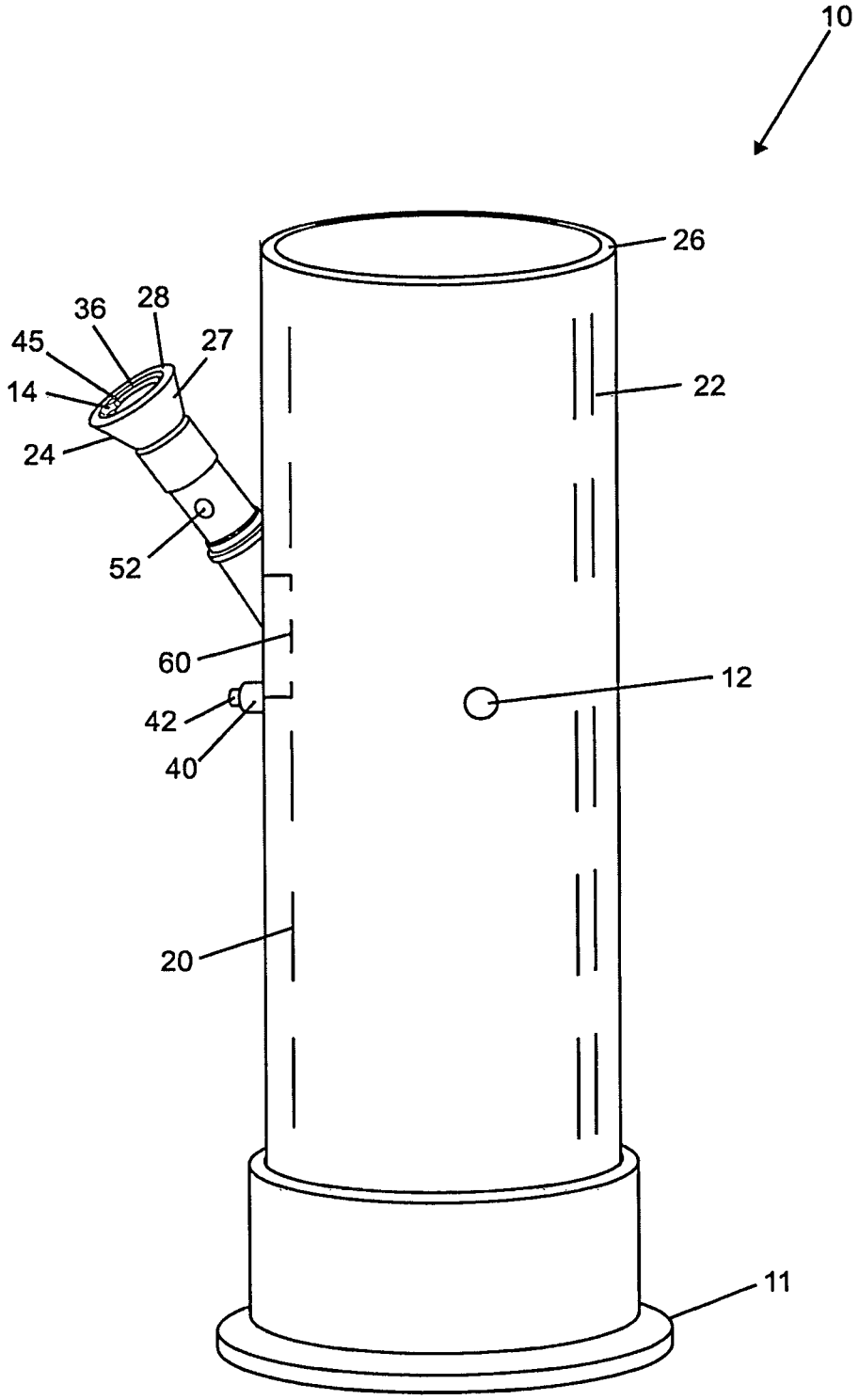
FIG. 2B is a rear isometric view of the third embodiment.
Figure 3A:
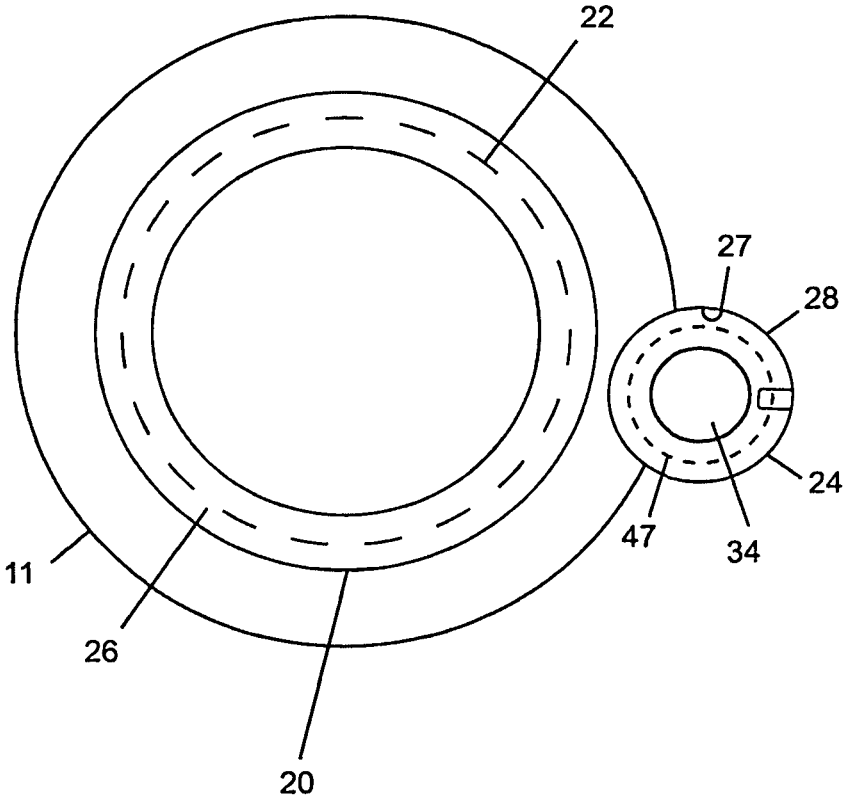
FIG. 3A is a top plan view.
Figure 3B:
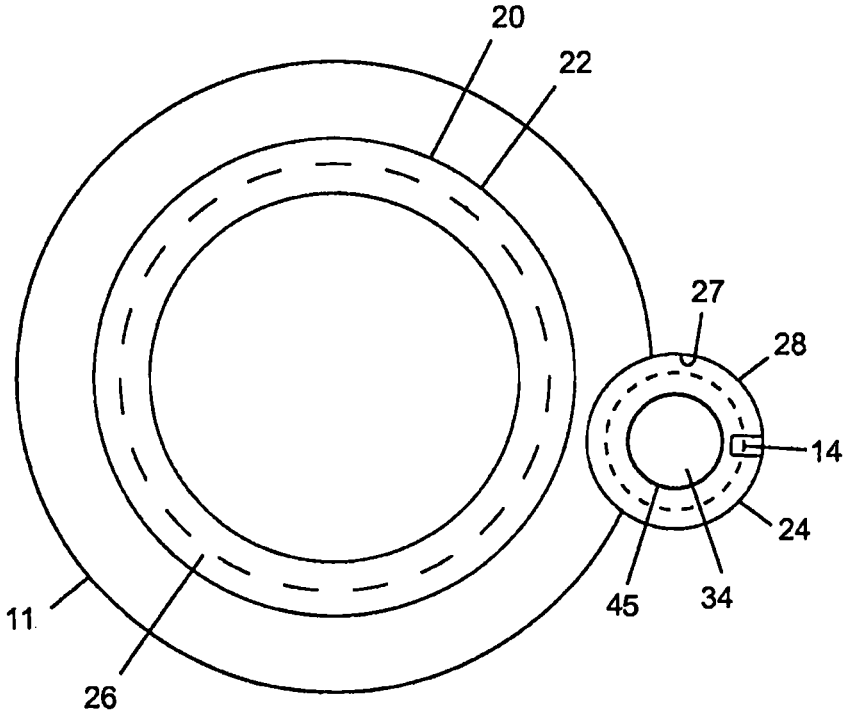
FIG. 3B is a top plan view of the second embodiment.
Figure 4A:
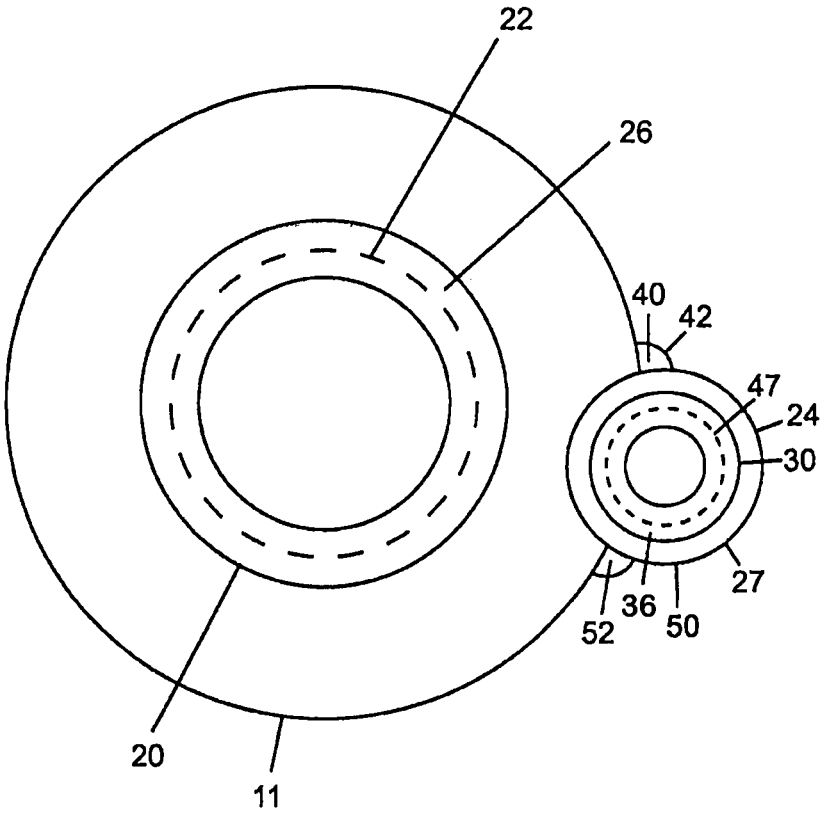
FIG. 4A is a bottom plan view.
Figure 4B:
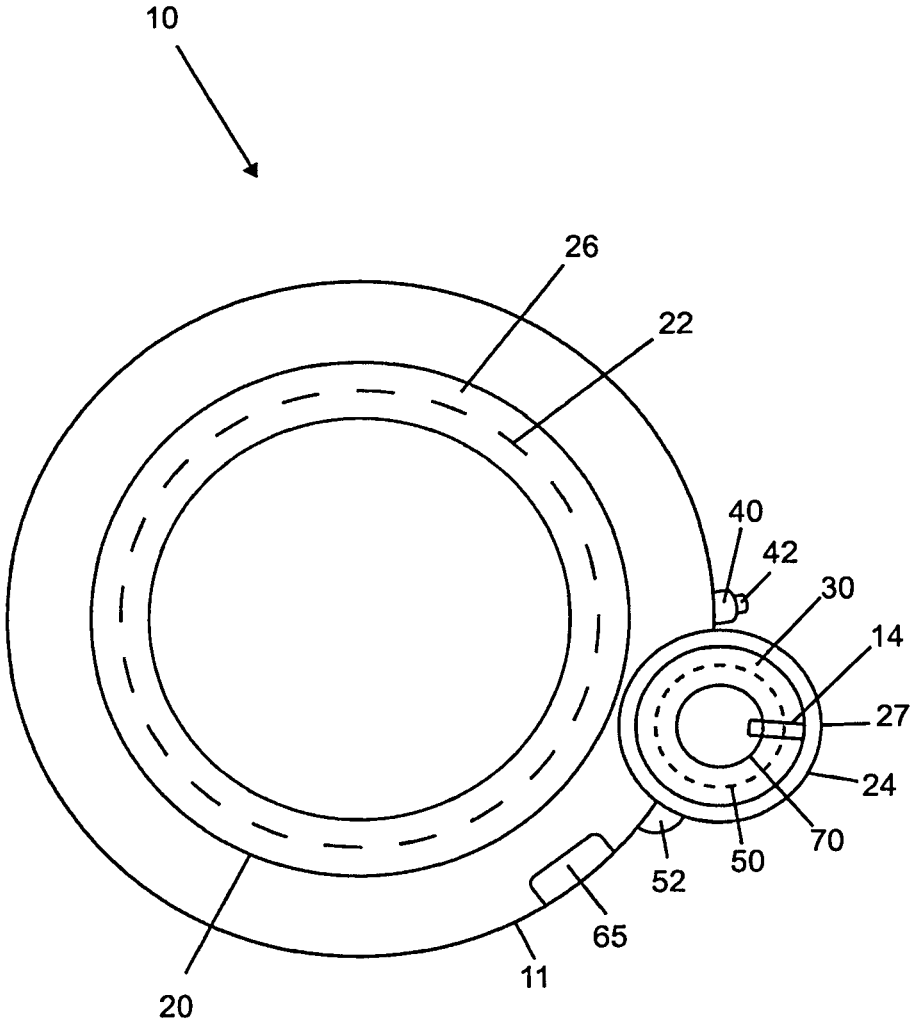
FIG. 4B is a bottom plan view of the third embodiment

With reference to FIG. 1B, the battery-operated ignition bong includes a single construction bong body having a stem 22, a bowl 24, a bottom end 30, and an outer wall 27. A micro USB charge receptacle 65 is built into the outer wall 27 which is connected to a wire 60 that connects the micro USB charge receptacle 65 to the battery 48, giving it the necessary means to charge itself and activate the ignition switch 42.

The invention claimed is:

1. A battery-operated ignition smoking bong comprising:

a single construction bong body having a stem, a bowl, a mouthpiece extending through the stem and in fluid communication with the bowl and an outer wall of the stem and the bowl, the bowl having a top edge, a bottom end, an outer wall, and an interior cavity having an inner perimeter;

a base from which the single construction bong body extends vertically, wherein the base has a wider diameter than the single construction bong body;

a battery-operated ignition switch disposed within the stem, the ignition switch having an activation button disposed on the stem;

a continuous indentation along the inner perimeter proximal the top edge;

a length of replaceable nichrome wire removably disposed within the indentation; a battery disposed within the stem, the battery being in operational communication with the ignition switch;

an ignition wire continuously disposed from the ignition switch, to the battery, encircling the interior cavity, a first portion of the ignition wire disposed in a position between the bottom of the bowl and the interior cavity, a second portion of the ignition wire disposed between the stem and the interior cavity, the ignition wire being in operational communication with the length of the nichrome wire;

wherein upon activation of the ignition wire, the ignition wire is configured to selectively activate the length of the nichrome wire to ignite the ignitable smoking substance disposed within the interior cavity of the bowl; and a USB charge receptacle built into the exterior of the bowl configured to permit the battery to be charged.

2. The battery-operated ignition smoking bong of claim 1 comprising:

a filter transversely disposed directly between the stem and the bowl; wherein the second portion of the igniter wire disposed between the stem and the interior cavity is further disposed between the filter of the interior cavity.

3. A battery-operated smoking bong comprising:

a single construction bong body having a stem, a bowl, a mouth piece extending through the stem and in fluid communication with the bowl and an outer wall of the stem and the bowl, the bowl having a top edge, a bottom end, an interior cavity defined by the top edge, the bottom end, and the outer wall of the bowl, and an inner perimeter of the interior cavity;

a base from which the single construction bong body extends vertically, wherein the base has a wider diameter than the single construction bong body;

a battery-operated ignition switch disposed with the stem, the ignition switch having an activation button disposed on the stem;

a battery disposed within the stem, the battery being in operational communication with the ignition switch;

a fuel reservoir disposed directly below and directly adjacent to the interior cavity of the bowl proximal the bottom end, wherein in the fuel reservoir is configured to contain an amount of fuel therein;

a refill nozzle accessible on the outer wall of the bowl in a position adjacent the fuel reservoir;

the refill nozzle being in fluid communication with the fuel reservoir;

an igniter wire continuously disposed from the ignition switch, to the battery, in from the battery to a bottom of the bowl adjacent the fuel reservoir; wherein the ignition switch is configured to activate the igniter wire;

wherein upon activation of the igniter wire, the igniter wire is configured to directly ignite the amount of fuel within the fuel reservoir to combust an ignitable smoking substance disposed within the interior cavity of the bowl; and a USB charge receptacle built into the exterior of the bowl configured to permit the battery to be charged.

4. The battery-operated ignition smoking bong of claim 3 further comprising:

a filter transversely disposed directly between the stem and the bowl.

* * * * *